United States Patent [19]

Sainen

[11] Patent Number: 5,060,161

[45] Date of Patent: Oct. 22, 1991

[54] METHOD OF CONTROLLING OPERATING SPEED OF A LOOM

[75] Inventor: Tsutomu Sainen, Kanazawa, Japan

[73] Assignee: Tsudakoma Corporation, Ishikawa, Japan

[21] Appl. No.: 442,994

[22] Filed: Nov. 29, 1989

[30] Foreign Application Priority Data

Nov. 30, 1988 [JP] Japan ..... 63-303183

[51] Int. Cl.[5] ..... G06F 15/46

[52] U.S. Cl. ..... 364/470; 139/336; 139/105

[58] Field of Search ..... 364/470; 139/110, 105, 139/1 R, 452, 71, 304, 1 E, 99, 97, 336

[56] References Cited

U.S. PATENT DOCUMENTS

| | | | |
|---|---|---|---|
| 4,494,203 | 1/1985 | Suzuki et al. | 364/470 |
| 4,525,787 | 6/1985 | Tzvetkov | 364/470 |
| 4,529,012 | 5/1985 | Sainen et al. | 139/110 |
| 4,553,569 | 11/1985 | Kimbara et al. | 364/470 |
| 4,556,945 | 12/1985 | Fry | 364/470 |
| 4,605,044 | 8/1986 | Sakano | 139/304 |
| 4,715,411 | 12/1987 | Van Bogaert et al. | 139/452 |
| 4,736,324 | 12/1990 | Sainen et al. | 364/470 |
| 4,884,597 | 12/1989 | Tamura et al. | 139/105 |
| 4,893,250 | 1/1990 | Sainen | 139/1 R |

*Primary Examiner*—Jerry Smith
*Assistant Examiner*—Jim Trammell
*Attorney, Agent, or Firm*—Wenderoth, Lind & Ponack

[57] ABSTRACT

A method of controlling an operating speed of the loom for increasing the production rate by varying the present operating speed so as to be increased includes a step of estimating a stop rate at the final point of time during a predetermined period at a certain time during the predetermined period, and comparing the estimated stop rate with a predetermined limit stop rate, and setting the present operating speed to increase it when the estimated stop rate is less than the limit stop rate and to decrease it when the estimated stop rate exceeds the limit stop rate.

5 Claims, 8 Drawing Sheets

$$Y_1 = \frac{T_0}{\tau} - n_i$$

$$X_1 = -\frac{\tau N_i n_i}{T_0}$$

$$Y_2 = \frac{T_0(100 - E_0)}{100\tau} - n_i$$

$$X_2 = -N_i + \frac{A n_i}{S_0(T_0 - \tau n_i)}$$

$$Y_3 = \frac{S_0(T_0 - \tau n_i)N_i - A n_i}{S_0 \tau N_i + A}$$

$$X_3 = -N_i$$

$$Y_4 = -n_i$$

| Sft | N | n | R | E | S | P |
|---|---|---|---|---|---|---|
| 1 | 700 | 7 | 5.6 | 91.9 | 2.27 | 3.09 |
| 2 | 700 | 9 | 4.3 | 92.0 | 2.91 | 3.09 |
| 3 | 700 | 4 | 3.9 | 96.7 | 1.23 | 3.25 |
| 4 | 700 | 3 | 5.2 | 96.8 | 0.92 | 3.25 |
| 5 | 700 | 5 | 4.0 | 95.8 | 1.55 | 3.22 |
| 6 | 700 | 4 | 5.9 | 95.1 | 1.25 | 3.20 |
| 7 | 700 | 4 | 0.8 | 99.3 | 1.20 | 3.34 |
| 8 | 700 | 5 | 3.1 | 96.8 | 1.54 | 3.25 |
| 9 | 700 | 1 | 1.7 | 99.7 | 0.30 | 3.35 |
| Average | | 5 | 4.1 | 96.0 | 1.45 | 3.23 |
| 10 | 760 | 8 | 4.9 | 91.8 | 2.51 | 3.18 |
| 11 | 800 | 13 | 4.3 | 88.5 | 3.93 | 3.31 |
| 12 | 800 | 8 | 4.7 | 92.2 | 2.26 | 3.54 |
| 13 | 800 | 11 | 4.7 | 89.2 | 3.21 | 3.42 |
| 14 | 800 | 8 | 2.3 | 96.2 | 2.17 | 3.69 |
| 15 | 800 | 12 | 5.9 | 85.2 | 3.67 | 3.27 |
| 16 | 800 | 13 | 3.5 | 90.5 | 3.74 | 3.48 |
| 17 | 800 | 15 | 4.7 | 85.2 | 4.59 | 3.27 |
| 18 | 800 | 10 | 2.9 | 94.0 | 2.77 | 3.61 |
| Average | | 11 | 4.3 | 90.3 | 3.18 | 3.42 |

Increase of
Production Rate : 1.74 (cmpx)

METHOD OF CONTROLLING OPERATING SPEED OF A LOOM

BACKGROUND OF THE INVENTION

1. Field of the Invention

The present invention relates to a method of controlling an operating speed of a loom in an optimum condition.

2. Prior Art

The applicant proposed an idea which was described in U.S. Ser. No. 324,536 and European Patent Application No. 89 104 577.5 to increase the operating speed of the loom taking into account a weaving condition during operation of the loom to thereby increase the production rate as much as possible.

The method comprises the steps of judging the quality of a fabric with reference to past data during operation of the loom and setting the operating speed of the loom to increase it or to decrease it on the basis of the result of the judgment of the quality of the fabric. During the controlling of the operating speed of the loom, when the fabric having a deteriorated quality is woven or the operator can not cope with or share a plurality of stopped looms during the controlling of the operating speed of the loom, there occurs a case that the operating condition of the loom is not placed in the optimum weaving operation during the collecting of the past data.

Hence, it is an important factor in the case of the controlling the operating speed of the loom to estimate the operating condition of the loom while the loom is kept in the optimum operating condition.

Accordingly, the object of the present invention is to provide a method of controlling the operating speed of the loom comprising the steps of estimating a stop rate of the loom taking into account a predetermined quality of the fabric and an operator's sufficient time for sharing the loom (hereinafter referred to as an operator's sufficient time) on the basis of the present data during the operation of the loom and setting the operating speed of the loom to the optimum operating condition on the basis of the estimated result.

In view of the object of the present invention, the method comprises the steps of: estimating a stop rate of the loom at the final point of time, the estimation being carried out at a certain point of time during a predetermined period while the operating speed of the loom is controlled to be increased so that the production rate is increased; comparing the estimated stop rate with a predetermined limit stop rate so that the operating speed of the loom is increased when the estimated stop rate is less than the predetermined limit stop rate and the operating speed of the loom is decreased when the estimated stop rate exceeds the predetermined limit stop rate. The limit stop rate is previously determined at least from the quality of the fabric or the operator's sufficient time. The quality of the fabric is generally determined on the basis of stop rate of the loom per length of the fabric (hereinafter referred to as the downtime rate of the loom). That is, as the downtime rate of the loom is increase, the stepped portion is increased in the fabric to thereby deteriorate the quality of the fabric. Accordingly, it is judged that the less the downtime rate of the loom, the better the quality of the fabric. The operator's sufficient time is determined by an operating rate of the loom. That is, the downtime of the loom comprises a waiting time, namely, the arrival time of the operator to the loom and a time needed by the operator for sharing the repair of the loom after the arrival of the operator. If the operator's time is sufficient, the waiting time is increased and the downtime of the loom is increased, whereby the operating rate of the loom is reduced. Accordingly, it is judged that the operator's sufficient time is increased as the operating rate is increased.

The method of controlling the operating speed of the loom comprises the steps of: controlling the stop rate on the basis of the estimated stop rate during the change of operating speed of the loom so that the fabric is prevented from being woven inferiorly during the step of controlling the operating speed of the loom or the operating speed of the loom is prevented from being increased at the state where there is insufficient operator's time.

The above and other objects, features and advantages of the present invention will become more apparent from the following description taken in conjunction with the accompanying drawings.

DESCRIPTION OF A PREFERRED EMBODIMENT OF THE INVENTION

Assume that the result of of i times of shift during operation of the loom has the following data.

Shifting time: $T_0$ (min)

Operating speed: $N_i$ (RPM)

Stop rate: $n_i$ (time/shift)

Average downtime: $\tau$ (min)

Production rate: $P_i$ (cmpx)

Operating rate: $E_i$ (%)

Downtime rate of the loom: $S_i$ (stop rate/cmpx)

where cmpx is a unit representative of 0.1 million picks.

The production rate $P_i$, the operating rate $E_i$ and the downtime rate of the loom $S_i$ are respectively determined as follows with reference to FIG. 1.

Figure 1:
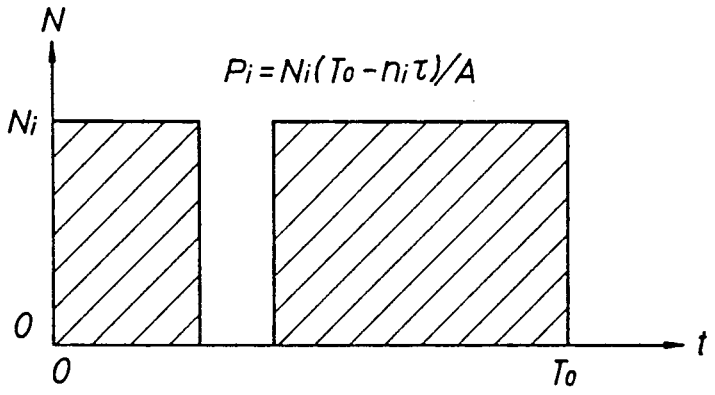
FIGS. 1 and 2 are graphs of assistance in explaining a relationship between a shifting time and operation and stoppage of the loom.

FIG. 1 shows the operation and stoppage of the loom during i times of shift in simplicity and the hatched portion corresponds to the production rate $P_i$.

$$P_i = \frac{N_i(T_o - n_i\tau)}{A}$$

$$E_i = \frac{100AP_i}{N_iT_o} = \frac{100(T_o - n_i\tau)}{T_o}$$

$$S_i = \frac{n_i}{P_i} = \frac{An_1}{N_i(T_o - n_i\tau)}$$

where $A = 100000$ $T_0 > n_i\tau$

The downtime rate of the loom $S_i$ becomes a factor for determining the quality of the fabric.

Assuming that there is the operator's sufficient time and the average stoppage time $\tau$ is not varied provided that the stop rate $n_i$ increased for the increment y when the operating speed of the loom is increased for the increment of x, the production rate $P_{i+1}$, the operting rate $E_{i+1}$ and the downtime of the loom during i+1 times of shift $S_{i+1}$ are expressed as follows.

$$P_{i+1} = \frac{(N_i + x)\,[T_o - (n_i + y)\tau]}{A}$$

$$E_{i+1} = \frac{100\,[T_o - (n_i + y)\tau]}{T_o}$$

$$S_{i+1} = \frac{n_i + y}{P_{i+1}} = \frac{A(n_i + y)}{(N_i + x)[T_o - (n_i + y)]6]}$$

where $$N_i + x > 0 \therefore x > -N_i$$

$$n_i + y > 0 \therefore y > -n_i$$

$$T_0 - (n_i + y)\tau > 0 \therefore y < (T_0 - \tau n_i)\tau$$

Figure 2:
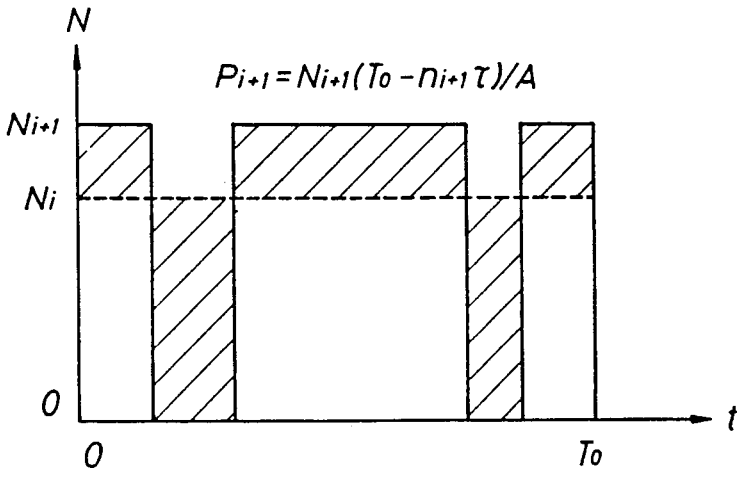

FIG. 2 shows the operation and stoppage of the loom during i+1 times of shift in simplicity. It is evident from FIG. 2 that with increase of the operating speed of the loom production rate is likely to increase but the production rate decreases with increase of the stop rate. A condition where the production rate increases during (i+1) times of shift where the operating speed of the loom is increased.

A difference Z of the production rate for the period between the i times of shift and (i+1) times of shift is expressed as follows.

$$Z = P_{i+1} - P_i = \frac{(T_o - n_i\tau)x - \tau(N_i + x)y}{A}$$

To meet $Z > 0$, the following expression is to be established.

$$\tau(N_i + x)y < (T_0 - n_i\tau)x$$

where, $\tau > 0$, $N_i + x > 0$, hence the above expression is expressed as follows.

$$y < \frac{(T_o - n_i\tau)x}{\tau(N_i + x)}$$

Figure 3:
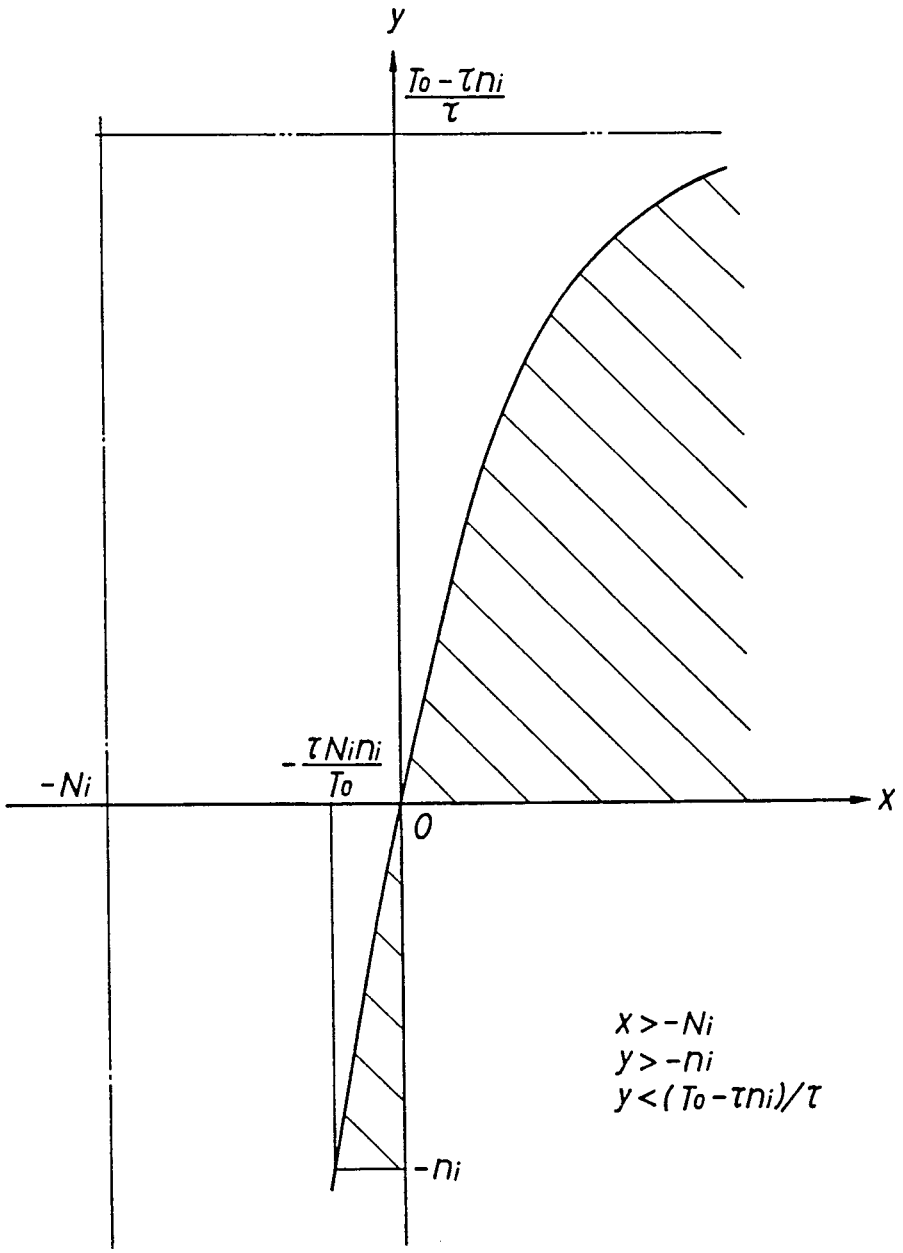
FIG. 3 is a graph of assistance in explaining a increment of an operating speed of the loom and an increment of the stop rate relative to the increase of a production rate.

FIG. 3 shows this portion in the hatched portion. A fourth quadrant in the same figure is omitted as out of scope since the stop rate is generally increased with increase of the operating speed of the loom.

In fact since the stop rate $n_i$, namely, y is a positive integer supposed that the increment $y = k$ (k is a positive integer) of the stop rate is established if the operating speed of the loom $N_i$ is increased for the increment of x, the following expression is established.

$$k < \frac{(T_o - n_i\tau)x}{\tau(N_i + x)}$$

$$k\tau x + k\tau N_i < (T_0 - n_i\tau)x$$

$$[T_o - (n_i + k)\tau]x > k\tau N_i$$

Since $T_o - (n_i + k) > 0$ $$x > \frac{k\tau N_i}{T_o - (n_i + k)\tau}$$

That is, when the stop rate $n_i$ is increased for the increment of k, the increment of the operating speed of the loom is necessary to be greater than $k\tau N_i/[T_o - (n_i + k)\tau]$ to increase the production rate $P_i$. In other word, the production rate P is increased if the increment of the stop rate $n_i$ is less than k when the increment of the operating speed of the loom is increased to be greater than $k\tau N_i/(T_o - (n_i + k)\eta)$.

For example, assuming that $k = 2$ and the operating speed $N_{i+1}$ of the loom is increased to become $N_{i+1} = 2\tau N_i/[T_o - (n_{i+2})\tau] + N_i$, the stop rate $N_{i+1} < n_i + 2$, namely, inasmuch as the $n_i$ and $n_i + 1$ are positive integers the production rate P will be increased if the expression $n_{i+1} \leqq n_{i+1}$ is established.

Studying the operator's sufficient time with reference to the operating rate, if the operating rate is greater than $E_o$, the operator can work with sufficient time and the following expressions are to be established provided that the average downtime is not varied.

$$E_i \geqq E_o$$

$$E_{i+1} \geqq E_o$$

Accordingly, the following expression is established.

$$\frac{100(T_o - n_i\tau)}{T_o} \geqq E_o \quad (1)$$

$$\frac{100[T_o - (n_i + y)\tau]}{T_o} \geqq E_o \quad (2)$$

from the expression (1)

$$100T_o - 100\tau n_i \geqq E_oT_o$$

$$100\tau n_i \leqq T_o(100 - E_o)$$

$$\therefore n_i \leqq \frac{T_o(100 - E_o)}{100\tau}$$

The $n_i$ is defined as the limit stop rate $Q_E$ during one shift in view of the operator's sufficient time. From the expression (2)

$$100T_o - 100n_i\tau - 100\tau y \geqq E_oT_o$$

$$100\tau y \leqq T_o(100 - E_o) - 100n_i\tau$$

Hence, the increment y of the stop rate for satisfying the expression $E_{i+1} \geqq E_o$ is to satisfy the following expression.

$$y \leqq \frac{T_o(100 - E_o) - 100n_i}{100\tau} = \frac{T_o(100 - E_o)}{100\tau} - n_i$$

Figure 4:
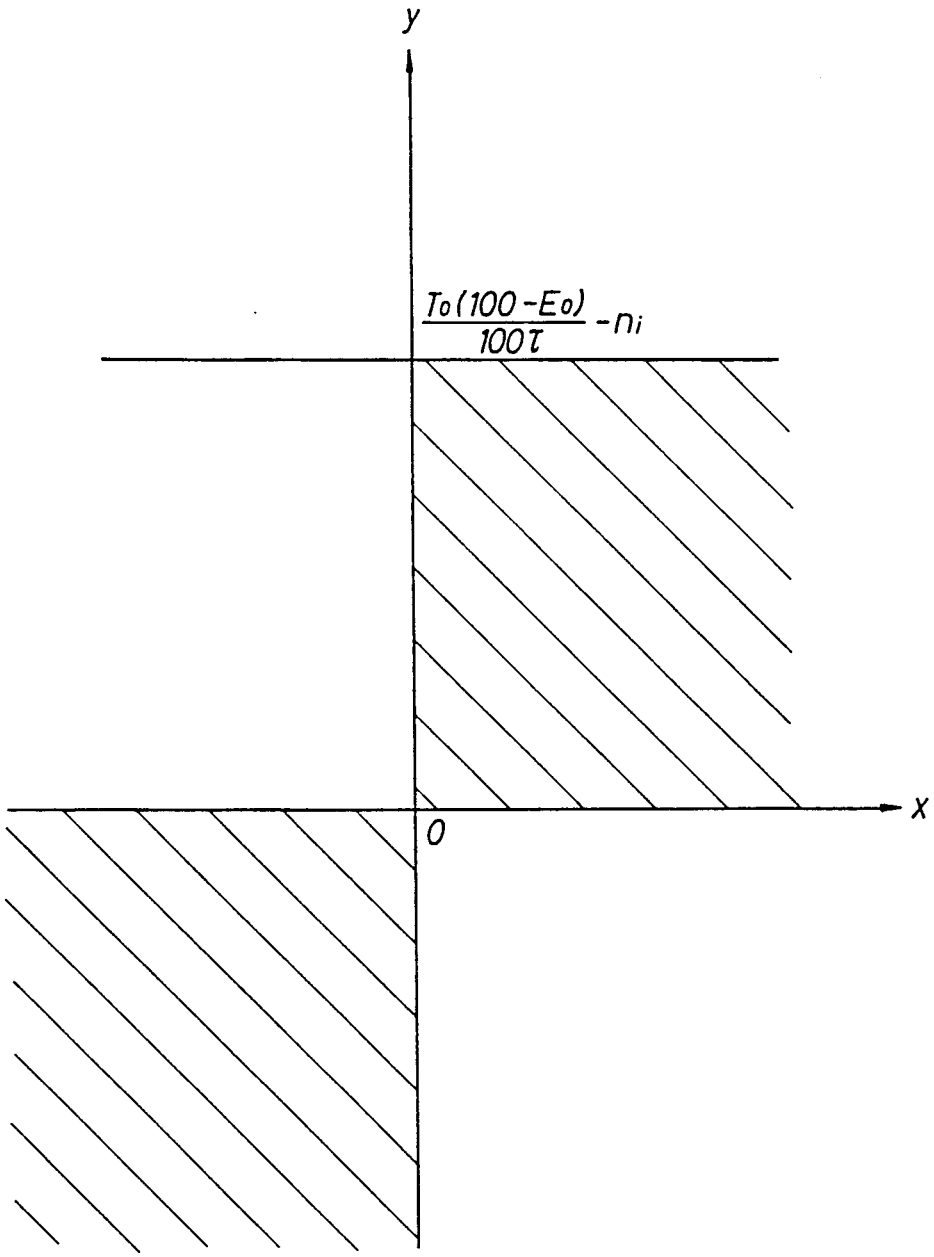
FIG. 4 is a graph of assistance in explaining the increment of the operating speed of the loom and the increment of the stop rate relative to an operating rate.

FIG. 4 shows the area satisfying the expression as the hatched portions.

Studying the quality of the fabric with reference to the downtime rate of the loom, provided that the standard that the fabric stands the test of the quality is determined if the downtime rate of the loom (stop rate/cmpx) is less than $S_o$, the following expressions are to be established.

$$S_i \leqq S_o$$
$$S_{i+1} \leqq S_o$$

$$\therefore S_i = \frac{An_i}{N_i(T_o - \tau n_i)} \leqq S_o \quad (3)$$

$$S_{i+1} = \frac{A(n_i + y)}{(N_i + x)[T_o - (n_i + y)\tau]} \leqq S_o \quad (4)$$

from the expression (3)

$$An_i \leqq S_oT_oN_i - S_o\tau N_in_i$$
$$(A + S_o\tau N_i)n_i \leqq S_oT_oN_i$$

$$\therefore n_i \leqq \frac{S_oT_oN_i}{A + S_o\tau N_i}$$

The $n_i$ is to be defined as the limit stop rate $Q_S$ during one shift of the loom relative to the quality of the fabric.

From the expression (4)

$$An_i + Ay \leqq S_o(N_{i+x})(T_o - \tau n_i) - S_o(N_{i+x})\tau y$$

$$(S_o\tau(N_{i+x}) + A)y \leqq S_o(T_o - \tau n_i)(x + N_i) - An_i$$

Accordingly, the increment y of the stop rate for satisfying the expression $S_{i+1} \leqq S_o$ is to satisfy the following expression.

$$y \leqq \frac{S_o(T_o - \tau n_i)(x + N_i) - An_i}{S_o\tau x + S_o\tau N_i + A}$$

Figure 5:
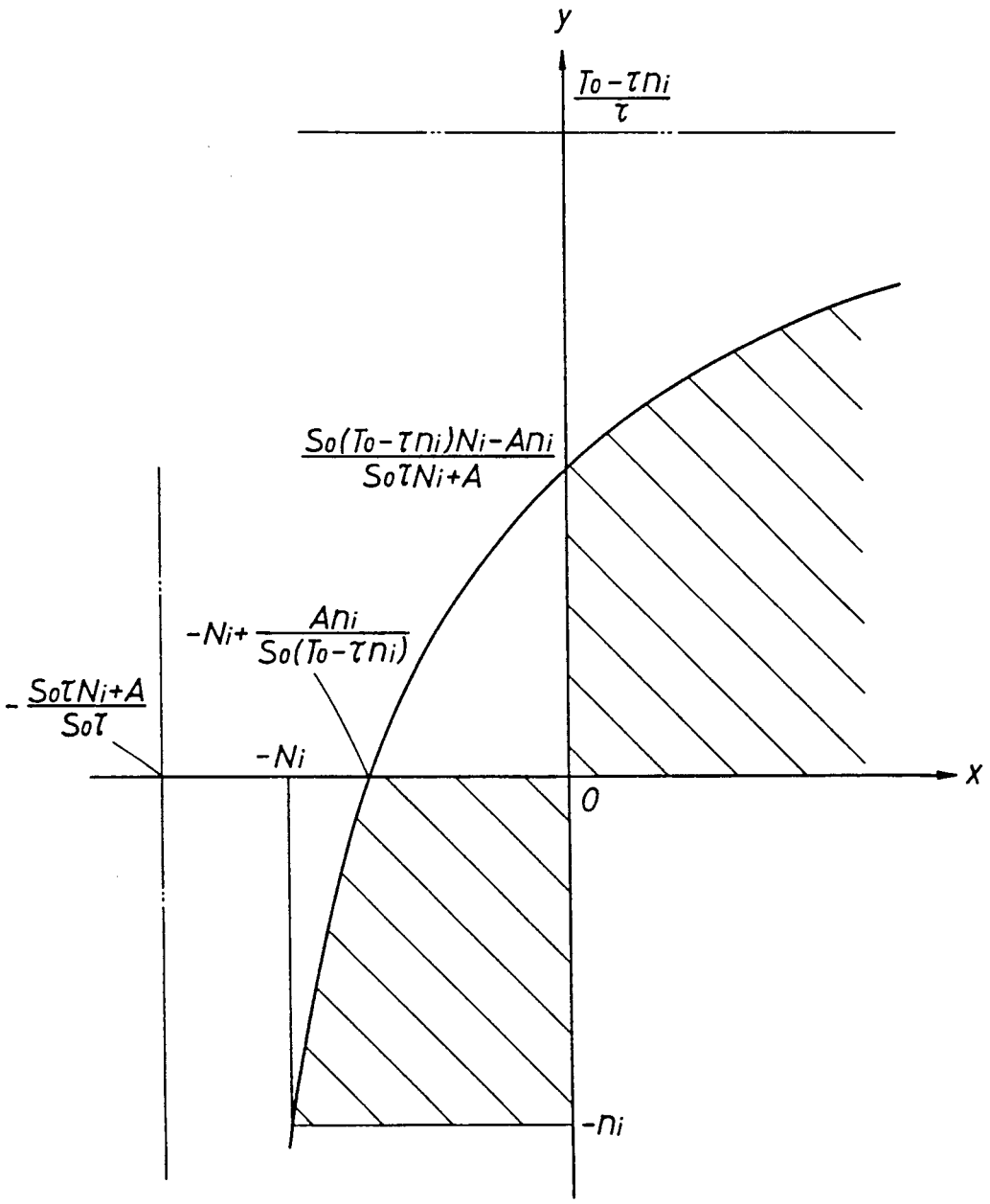
FIG. 5 is a graph of assistance in explaining the increment of operating speed of the loom and the increment of the stop rate relative to a downtime rate of the loom.

FIG. 5 shows an area satisfying the expression just above. The following expression will be established provided that y=k (k is a positive integer).

$$k \leqq \frac{S_o(T_o - \tau n_i)(x + N_i) - An_i}{S_o\tau x + S_o\tau N_i + A}$$

$$kS_o\tau x + k(S_o\tau N_i + A) \leqq S_o(T_o - \tau n_i)x + S_o(T_o - \tau n_i)\text{-}N_iA_i$$

$$S_o(k\tau - T_o + \tau n_i)x \leqq S_o(T_o - \tau n_i)N_i - k(S_o\tau N_i + A)\text{-} - An_i$$

From $(k + n_i)\tau - T_o < 0$ $$x \geqq \frac{S_o(T_o - n_i)N_i - k(S_oN_i + A) - An_i}{S_o[(k + n_i)\tau - T_o]}$$

That is, when the stop rate is increased for the increment of k times, no quality problem will occur if the increment x of the operating rate satisfies the expression set forth just above. In other words, no quality problem will occur if the operating speed is increased more than x establised just above provided that the increment of the stop rate is less than k time.

Figure 6:
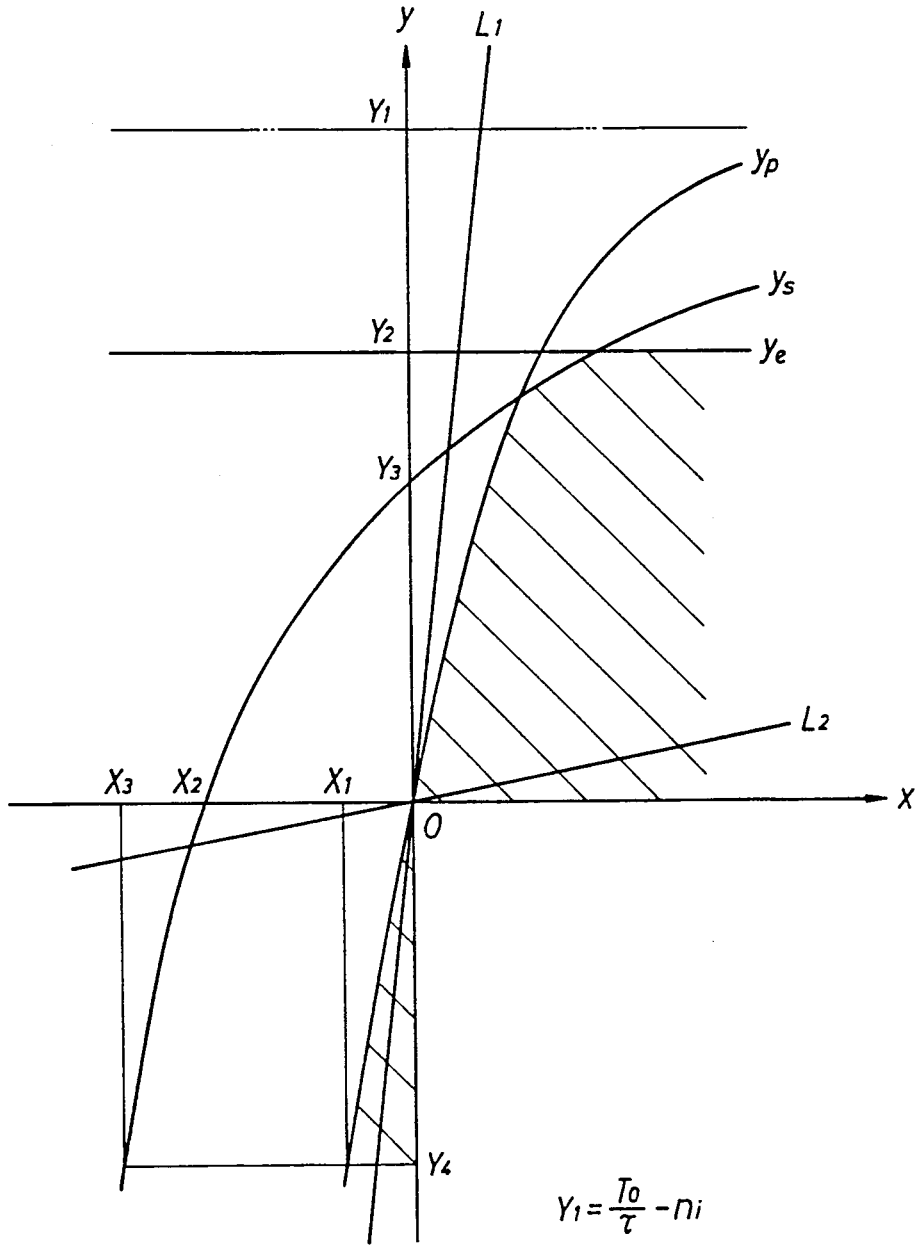
FIG. 6 is a graph of assistance in explaining the increment of the operating speed of the loom and the increment of the stop rate relative to the operating rate, the downtime rate of the loom and the production rate.

FIG. 6 is a single graph representing the combination of graphs of FIGS. 3, 4 and 5. Evident from FIG. 6 is the the area (hatched portion) where the conditions of both the operator's sufficient time (operating rate $E_o$) and the quality of the fabric (stoppage level $S_o$) are satisfied and the production rate $P_i$ is increased.

Generally the stop rate is increased as the operating speed is increased. The stop rate can be represented by, for example, straight lines $L_1$ and $L_2$ as illustrated in FIG. 6, provided that the stop rate is proportional to the increment of the operating speed of the loom although it is a positive integer.

The straight line $L_1$ is deviated from the area defined by a curved line $y_p$ in case of $x>0$ and within the same area in case of $x<0$. When the stop rate is varied greatly, accompanyied by the variation of the operating speed, the production rate is not, increased even if the operating speed is increased; rather, the production rate is expected to be increased when the operating speed is decreased.

The straight line $L_2$ is within the area defined by the curved line $y_p$ in case of $x>0$ and is out of the same area in case of $x<0$. In such case, the production rate is increased when the operating speed is increased but the production rate is not increased even if the operating speed is decreased.

In the case represented by the straight line contacting the curved line $y_p$ at the origin, the production rate will be decreased when the operating speed is increased or decreased and the same straight line becomes the optimum point of the operating speed in order to maximize the production rate.

Although the theory can be applicable to the case set forth above, the ratio of increase and decrease of the operating speed to those of the stop rate can not be determined since the straight lines $L_1$ and $L_2$ are practically not known.

Hence, the above tendency is estimated with reference to the algorithm set forth hereunder to control the operating speed.

The followings are definitions of estimating controls, judgment based on the estimated control and prosecution made by the judgment assuming that the production rate is P at the elapsed time t=T, the stop rate is n, the operating time is r, and the operating speed is N.

(1) Estimation of Parameter

Provided that the result of each parameter at present, namely, at the elapsed time t=T is kept advanced as it is until reaching to a cetain elapsed time $t=T_o$ which is a completion time of one shift, the production rate P, the stop rate n, the operating rate E and the downtime rate of the loom S are estimated as follows. Estimated values are marked at .

$$\hat{P} = T_oP/T$$

$$\hat{n} = T_on/T$$

$$\hat{E}=100A\hat{P}/T_oN$$

$$\hat{S}=\hat{n}/\hat{P}$$

A limited stop rate $Q_S$ satisfying a limited downtime rate of the loom $S_o$ and during one shift and a limited stop rate $Q_E$ satisfying an operating rate during one shift are expressed as follows from the explanation set forth above.

$$Q_S=S_oT_oN/(A+S_o\tau N)$$

$$Q_E=T_o(100-E_o)/100\tau(\text{where } \tau\neq 0)$$

$$\tau=(T-r)/n$$

Figure 7:
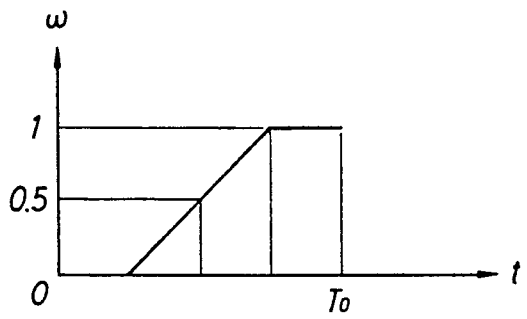
FIG. 7 is a graph of assistance in explaining a weighting relative to an elapsed time.

(2) Setting of Weighting Coefficient (Refer to FIG. 7)

Inasmuch as the certainty of the estimated value will be increased as the elapsed time t=T draws to close to $T_o$, the weighting coefficient value can be set, for example, to as follows corresponding to the elapsed time.

$w=0$ in case of $T<T_o/4$ $w=(2T/T_o)-0.5$ in case of $T_o/4\leqq T<3T_o/4$ $w=1$ in case of $T\leqq 3T_o/4$ (3) Judgement (a) Operating speed down in case of $\hat{n}>Min(Q_S, Q_E)$ When the estimated stop rate $\hat{n}$ exceeds one of less values of $Q_S$ or $Q_E$, it will be changed in the direction to decrease the operating speed. At this time, a variation ratio $\Delta N$ is, for example, determined in the following manner.

The increment Y of a desired stop rate after variation of the operating speed is expressed as follows.

$$Y=(Min(Q_S, Q_E)-\hat{n})/2\ Y<0$$

The result shows $Y<0$ which represents the decrement of the stop rate. The above expression shows, to prevent excessive control, that the increment Y of the stop rate after variation of the operating speed is set to be half of the difference between the limit stop rate and the estimated stop rate as an example. However, the increment Y for a provisional stop rate can be varied to be decreased or increased by allowing the denominator values to be greater or less than 2.

The increment X of the operating speed satisfying the increment Y can be determined from the following expression using the relationship between the increment x of the operating speed and the increment k of the stop rate.

$$x=Y\cdot\tau\cdot N/(T_o-(\hat{n}+Y)\tau)$$

A discriminant expression W is defined as follows using the weighting coefficient w corresponding to the elapsed time and the weighting coefficient $W_N$ of the increment X of the operating speed determined by the expression just set forth above can be determined as follows.

Suppose that $W=w[\hat{n}-Min(Q_S, Q_E)]$.

$W_N=0$ in case of $W\leqq 0$ $W_N=W$ in case of $0<W<1$ $W_N=1$ in case of $W\geqq 1$ The variation ratio $\Delta$ N of the operating speed can be expressed as follows from the thus determined increment X and the weighting coefficient $W_N$.

$$\Delta N=W_N\cdot X$$

(b) Operating speed up in case of $\hat{n}\leqq Min(Q_S, Q_E)$

When the estimated stop rate n is less than the limit stop rate $Q_S$ or the limit stop rate $Q_E$, it will be varied in the direction so as to increase the operating speed. At this time, the variation ratio $\Delta$ N can be determined, for example, as follows in the same way as (a).

$$Y=(Min(Q_S, Q_E)-\hat{n})/2\ Y\geqq 0$$

$$x=Y\cdot\tau\cdot N/(T_O-(\hat{n}+Y)\tau)$$

Suppose that $W=w(\hat{n}-Min(Q_S, Q_E))$.

$W_N=0$ in case of $0<W$ $W_N=|W|$ in case of $-1<W\leqq 0$ $W_N=1$ in case of $W\leqq -1$ $N=W_N\cdot X$ (c) Suppose that the maximum ratio of the variation ratio $\Delta$ N of the operating speed is $\Delta N_o$ and $\Delta N=\Delta N_o$ in case of $|\Delta N|>\Delta N_o$.

(d) Suppose that the upper limit and the lower limit of the variation range of the operating speed are respectively $N_{max}$, $N_{min}$.

$N=N_{min}$ in case of $N_{min}>N+\Delta N$ $N=N_{max}$ in case of $N_{max}<N+\Delta N$ $N=N+\Delta N$ in case of $N_{min}\leqq N+\Delta N\leqq N_{max}$ The operating speed is to be varied in the course of shifting loom as set forth above so that the stop rate at the time of completion of one shift does not exceed the limit stop rates $Q_S$ and $Q_E$. The control method is confirmed by the computer simulation which results in the following. The computer simulation was carried out under the following steps.

(1) Generation of downtime

The situation of generation of downtime is given by a Poisson distribution. Provided that the number of $\lambda$ of the downtime per unit time is generated, the probability of stoppage of the loom for the number of s times during the interval of T can be determined by the following expression.

$$P(S,\lambda T)=\frac{e^{-\lambda T}(\lambda T)^s}{S!}$$

where $\lambda T$ is an average downtime of the loom for the interval of T. The exponential distribution can be expressed as follows if the time interval per unit time is represented by the distribution type.

$$P(t)=\lambda e^{-\lambda T}$$

where $1/\lambda$ is an average value of the distribution.

(2) Service time

A service time (downtime of the loom) is given by the index distribution. The service time is expressed as follows, assuming that an average service ratio (average number of services per unit time) is $\mu$.

$$P(t)=\mu e^{-\mu T}$$

where $1/\mu$ is an average value of the distribution which accords to the average service time.

(3) In the case of a weaving mill $T_o$: shifting time n: stop rate in total

N: operating speed

R: service time/stop

Suppose that the data set forth above is given, the following definitions are expressed.

$$\lambda = \frac{n}{T_o} \text{ (stop rate/min)}$$

$$\mu = \frac{1}{R} \text{ (service rate)}$$

where each distribution for each item is expressed as follows.

| | | | |
|---|---|---|---|
| distribution of downtime interval | $P(t)$ | = | $\lambda e^{-\lambda t}$ |
| distribution of service time | $P(t)$ | = | $\mu e^{-\mu t}$ |

Figure 8:
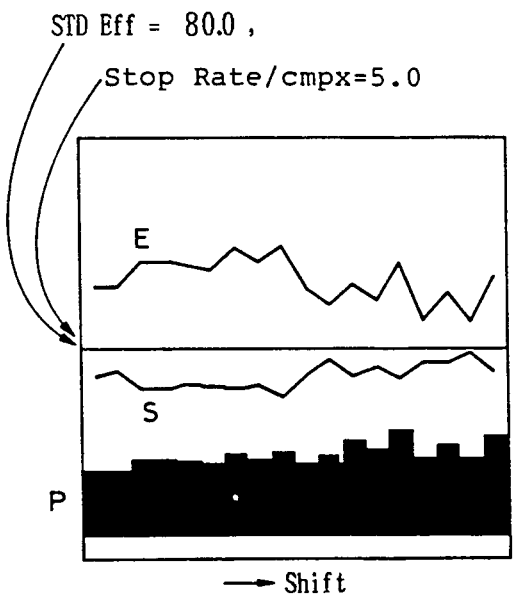
FIG. 8 is a view of assistance in explaining an example of result made by a computer simulation.

FIG. 8 shows an example of the result of the computer simulation supposing that the limit operating rate $E_o=80.0(\%)$ and the limit downtime rate $S_o=5.0$ (stop rate/cmpx).

The simulation operation is effected while the control according to the present invention is turned off during the first 1 to 9 shifts. The simulation operation is effected while the control according to the present invention is turned on during next 10 to 18 shifts.

Inasmuch as each data is varied for each shift it is difficult to find out the variations of the operating rate, the downtime rate of the loom, the limit operating rate and the production rate. However, the stop rate n is increased from 5 to 11, the operating rate E is decreased from 9.6 to 9.0, the downtime rate of the loom S is increased from 1.45 to 3.18 and the production rate P is increased from 3.23 cmpx to 3.42 cmpx. This means that the production rate P is inceased 1.74 cmpx during the total of 9 shifts.

Although the operating rate and the downtime rate are both deteriorated, it is evident that the limit operating rate (STD Eff) does not exceed 8.0% and the limit downtime rate of the loom (STD stop rate/cmpx) does not exceed 5.0.

According to the present invention, the stop rate at the final point of time during the predetermined period is previously estimated and the operating speed is increased or decreased not to exceed the limit stop rate determined from the estimated value and the quality of the fabric, namely, from the downtime rate and the operator's sufficient time, namely from the limit stop rate determined from the operating rate. Hence, the production rate can be increased so as to be as high as possible since the predetermined set quality of the fabric or the operator's sufficient time are satisfied at the time of completion of the predetermined period and the operating speed can be controlled on the basis of the prospective estimation.

In case the operating speed is to be varied every time the fabric is stopped, the inferior influence on the quality of the fabric caused by the variation of operating speed during the weaving operation is eliminated. Furthermore, if the estimated value is weighted, the greater variation at the early shifting period having less data does not occur, thereby stabilizing the operating speed.

Figure 9:
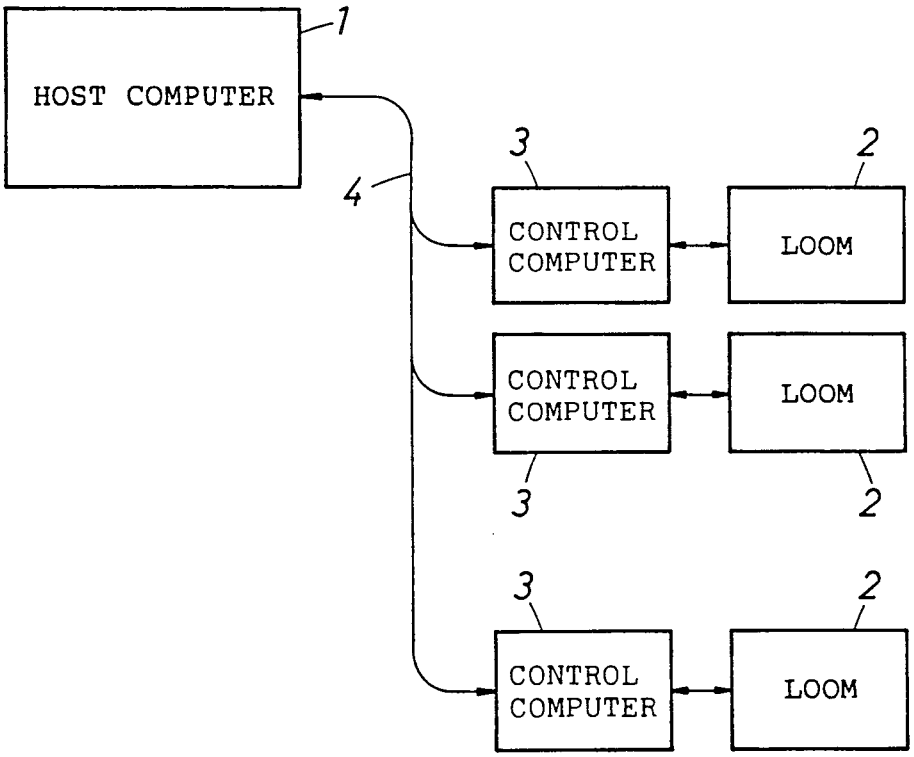
FIG. 9 is a block diagram showing a control system.

FIG. 9 shows a system when the method of controlling the operating speed according to the present invention is carried out.

A host computer 1 having stored therein a program of the method of controlling the operating speed is connected to computers 3 for controlling a plurality of looms 2 (hereinafter refered to as control computers) via a data line 4. The program stored in the host computer 1 specifies the loom 2 to be controlled within a predetermined time (set more than one time) during the predetermined period to thereby execute the program of the method of controlling the operating speed. The control can be carried out every time that the loom 2 is stopped or at a predetermined period.

Figure 10:
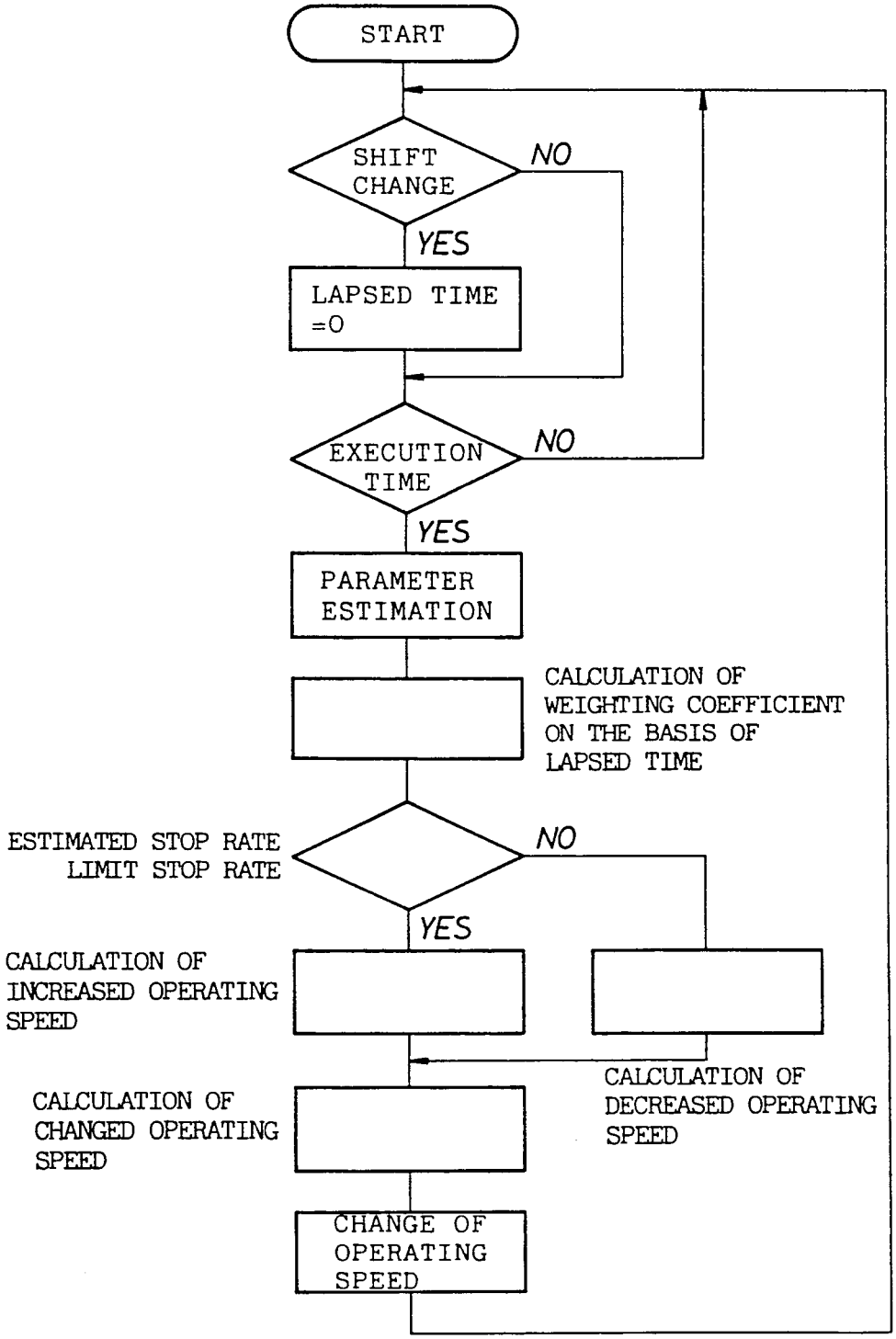
FIG. 10 is a flowchart showing a program for controlling the operating speed of the loom.

FIG. 10 is a flowchart carrying out the method of contolling the operating speed.

In a first step, after starting the program, a determination is made as to whether or not a shift change has occurred. If the shift change has occurred the program goes to a second stop where the elapsed time is set to 0 and goes to a third step where the execution time for controlling the loop 2 is judged. If the shift change has not occurred at the first step, the program jumps the second step and goes to the third step. The execution time in the step 3 is set after a lapse of the predetermined time or the stop of the loom as mentioned above. The host computer 1 executes an estimation of parameters relative to the loom 2 supposing that the shift change has been completed in a fourth step when the predetermined time has elapsed after the completion of execution of the control program or when the loom 2 is stopped, thereby executing an arithmetic operation of data necessary for the parameter. The host computer 1 calculates the weighting coefficient w corresponding to the lapsed time from the shift change in a fifth step and then determines if determined estimated stop rate $\hat{n}$ is within the limit stop rate $Q_S$ or $Q_E$ in a sixth step. If the estimated stop rate n is within the limit stop rate $Q_S$ or $Q_E$, the host computer 1 calculates the amount that the operating speed is to be incremented in a seventh step. However, if the estimated stop rate $\hat{n}$ is not within the limit stop rate $Q_S$ or $Q_E$, the host computer 1 calculates the operating speed to be decremented in an eighth step. In a ninth step, the operating speed after the shift change is calculated and thereafter, the host computer 1 feeds the control computer 3 a new operating speed in a tenth step to thereby change the operating speed of the corresponding loom 2. After a series of programs are executed, the same control in one shift is repeated for the next execution time. In such a manner, the operating speed of the loom 2 to be controlled is set to increase the production rate as much as possible within the limited stop rate determined from the downtime rate of the loom or the opeating rate and within the operator's sufficient time. The variation rate of the operating speed is limited so as not to exceed the predetermined value. The operating speed is changed within a predetermined maximum or the minimum operating speed.

In case the host computer is used only for collecting the data of the operation of a plurality of looms 2 and for the storing thereof, the method of controlling the operating speed according to the present invention is respectively executed by the control computer 3 of the loom 2.

Although the invention has been described in its preferred form with a certain degree of particularlity, it is to be understood that many variations and changes are possible in the invention without departing from the scope thereof.

What is claimed is:

1. A method of controlling an operating speed of a loom comprising the steps of:

estimating a stop rate of the loom at a final point of time during a predetermined period of a weaving operation, the estimation being carried out at a certain point of time during the predetermined period; and comparing the estimated stop rate with a predetermined limit stop rate and setting the present operating speed of the loom to increase it when the estimated stop rate is less than the limit stop rate and setting the present operating speed of the loom to decrease it when the estimated stop rate exceeds the limit stop rate.

2. A method of controlling an operating speed of a loom according to claim 1, wherein the limit stop rate is determined by one of a predetermined quality of the fabric and an operator's sufficient time for sharing the loom.

3. A method of controlling an operating speed of a loom according to claim 1, wherein a weighting coefficient calculation operation is carried out corresponding to the lapsed time from a first point of time of the predetermined period unit the final point of time of the same predetermined period during the execution of an arithmetic, the weighting coefficient being used to calculate the change the present operating speed of the loom on the basis of the estimated stop rate.

4. A method of controlling an operating speed of a loom according to claim 2, wherein the quality of the fabric is judged from a downtime rate of the loom.

5. A method of controlling an operating speed of a loom according to claim 2, wherein the operator's sufficient time for sharing the loom is determined from an operating rate of the loom.

* * * * *